United States Patent [19]

Davies

[11] 3,944,772

[45] Mar. 16, 1976

[54] CIRCUIT BREAKER WITH LOW TORQUE MOTOR

[75] Inventor: Norman Davies, Trafford, Pa.

[73] Assignee: Westinghouse Electric Corporation, Pittsburgh, Pa.

[22] Filed: Oct. 18, 1974

[21] Appl. No.: 515,946

[52] U.S. Cl. ..... 200/153 SC; 335/76

[51] Int. Cl.[2] ..... H01H 3/30

[58] Field of Search..... 200/153 SC, 153 R; 335/68, 335/76, 46; 74/54 B; 185/40

[56] References Cited

UNITED STATES PATENTS

| | | | |
|---|---|---|---|
| 3,254,186 | 5/1966 | Fischer | 200/153 SC |
| 3,806,684 | 4/1974 | Hauser | 200/153 SC |
| 3,849,619 | 11/1974 | Patel | 200/153 SC |

*Primary Examiner*—Robert K. Schaefer
*Assistant Examiner*—William J. Smith
*Attorney, Agent, or Firm*—L. P. Johns

[57] ABSTRACT

A circuit breaker characterized by spring means for closing contacts, means for charging the spring means and including a crankshaft structure, a ratchet wheel rotatably mounted on the shaft, driving pawl means operable to advance the ratchet wheel for charging the spring means, an oscillating drive pawl structure in driving engagement with said ratchet wheel, means operable to oscillate said drive pawl structure and comprising a bight portion movable across the axis of the output shaft of a charging motor.

8 Claims, 6 Drawing Figures

CIRCUIT BREAKER WITH LOW TORQUE MOTOR

BACKGROUND OF THE INVENTION

1. Field of the Invention

This invention relates to a motor operated spring closing circuit breaker and, more particularly, it pertains to an improved circuit breaker having a low torque charging motor.

2. Description of the Prior Art

Certain types of circuit breakers are provided with spring means for closing the circuit breaker contacts in which the spring means have been charged by a ratchet wheel fixedly mounted on a charging shaft. For example, in U.S. Pat. No. 3,254,186, a ratchet wheel is mounted on a crankshaft for charging springs for closing the circuit breaker contacts. Ordinarily, the springs are charged by a double reduction motor which from the cost standpoint is undesirable. A single reduction motor having a lower cost would be adequate, but the use of such a motor is limited because of the lower available torque. Moreover, heretofore the charging motor actually charges the springs only during one quarter of its turn, whereby three quarters of the turn involves idling or wasted energy.

SUMMARY OF THE INVENTION

In accordance with this invention it has been found that the foregoing problems may be overcome by providing a single reduction motor having an improved arrangement with respect to the ratchet wheel and the oscillating drive pawl structure for driving said wheel. The oscillating drive pawl structure includes a bight portion which is movable across the axis of the output shaft of the motor, remains in contact with an eccentric portion of the output shaft, and is moved in the charging direction by said portion during one half (180°) of the turn of the shaft.

The advantage of the improved arrangement is that either a smaller motor may be used to charge the spring during 180° of the turn of the motor shaft, or the same motor may be used for charging heavier springs to obtain higher fault closing capabilities in the circuit breaker.

BRIEF DESCRIPTION OF THE DRAWINGS

FIG. 6 is a fragmentary side view showing another embodiment of the crank means.

DESCRIPTION OF THE PREFERRED EMBODIMENT

Figure 1:
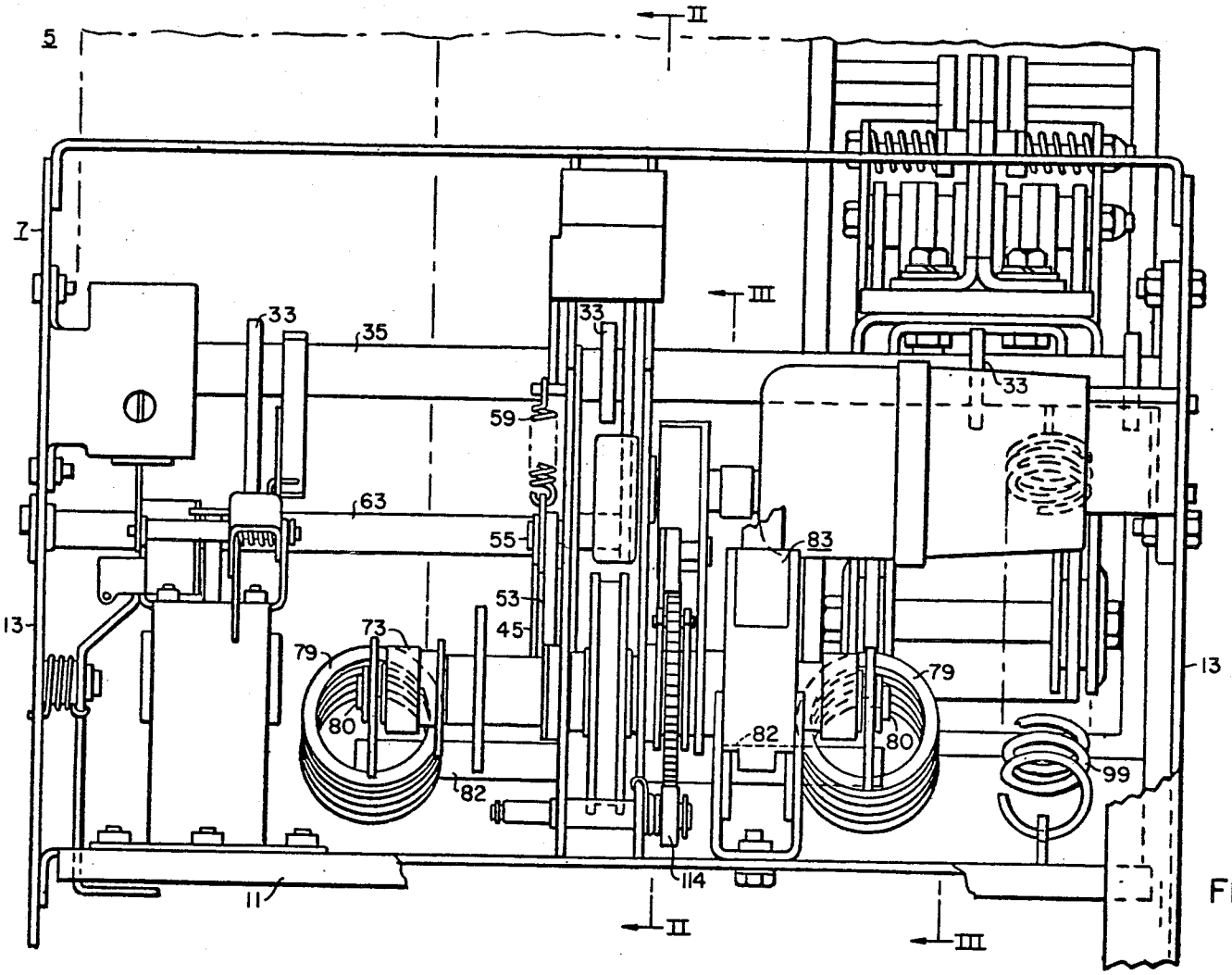
FIG. 1 is an end view with parts broken away and certain parts omitted for clarity of a circuit breaker constructed in accordance with this invention.
Figure 2:
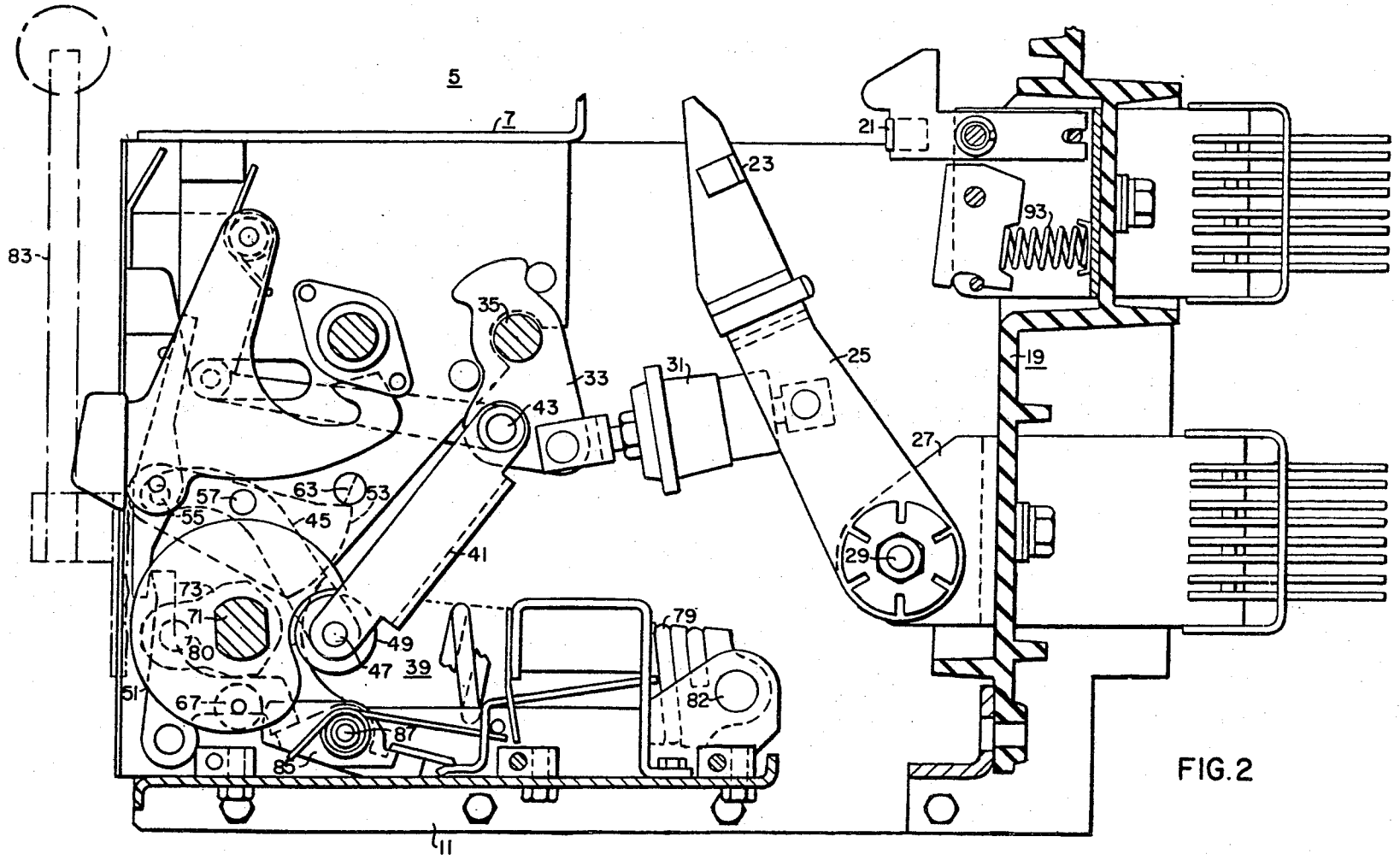
FIG. 2 is a sectional view taken generally along the line II—II of FIG. 1.

The circuit breaker of this invention is substantially similar to that disclosed in U.S. Pat. No. 3,689,720. Referring to the drawings there is shown in FIGS. 1 and 2 a three-pole circuit breaker 5 comprising a support structure or housing 7 and a circuit breaker structure 9 supported on the housing structure. The housing structure 7 comprises a metallic base plate 11, a pair of spaced metallic side plates 13 fixedly secured to flanges of the base plate, a pair of metallic center plates 17 fixedly mounted on the base plate, and a back wall structure indicated generally at 19.

The circuit breaker structure 9 is a three-pole structure comprising a stationary contact 21 (FIG. 2) and a movable contact 23 for each pole unit. Each of the movable contacts 23 is supported on a conducting contact arm 25 that is pivotally supported on a terminal conductor 27 by means of a pivotal support means 29. In each pole unit, a separate insulating connecting member 31 is pivotally connected at one end thereof to the contact arm 25 and at one end thereof to the contact arm 25 at the center end thereof a lever 33 that is welded to a common jack shaft 35 that extends across all of the poles of the circuit breaker. There is a separate lever 33 for each pole unit welded to the common jack shaft 35. Only one of the contact structures is shown in FIG. 1. The contact structures for the center pole and for the left-hand pole (FIG. 1) are omitted from the drawing in FIG. 1 merely for clarity. It can be understood that the contact structures for all three pole units are the same as the one contact structure shown in FIGS. 1 and 2.

The jack shaft 35 is supported for pivotal movement, about the elongated axis thereof, on the side plates 13 and center plates 17. The connecting member 31, levers 33, and jack shaft 35 are part of a stored-energy spring-closing mechanism 39 that is operable to close the contacts 23, 21. The mechanism 39 comprises a link 41 that is pivotally connected, at one end thereof, to the lever 33 of the center pole by means of a pin 43. The link 41 is pivotally connected at the other end thereof, to a link 45 by means of a knee pivot pin 47. A roller member 49, that serves as a cam follower, is mounted on the pin 47 to cooperate with a closing cam 51. The link 45 is pivotally connected at the other end thereof to a latch member 53 by means of a pin 55. The latch member 53 is mounted for pivotal movement about a fixed pivot pin 57 that is supported on the left-hand (FIG. 1) center plate 17. A tension spring 59 is connected to the pin 55 to reset the linkage following a tripping operation of the circuit breaker. The latch member 53 engages the periphery of a trip shaft 63 in proximity to a cut-out portion of the shaft 63, which cut-out portion is provided so that when the trip shaft 63 is rotated in a counterclockwise direction the latch member 53 will be free to move into the cut-out portion to the tripped position. The trip shaft 63 is supported for pivotal movement about the elongated axis thereof between one of the center plates 17 and one of the side plates 13.

A roller latch 67 (FIG. 2) is rotatably supported on and between the twin plates of the closing shaft 71 that is rotatably supported on suitable bearings that are secured to the center plates 17. A pair of crank arms 73 are fixedly mounted on the crank shaft 71 at the opposite ends of the crank shaft.

Figure 3:
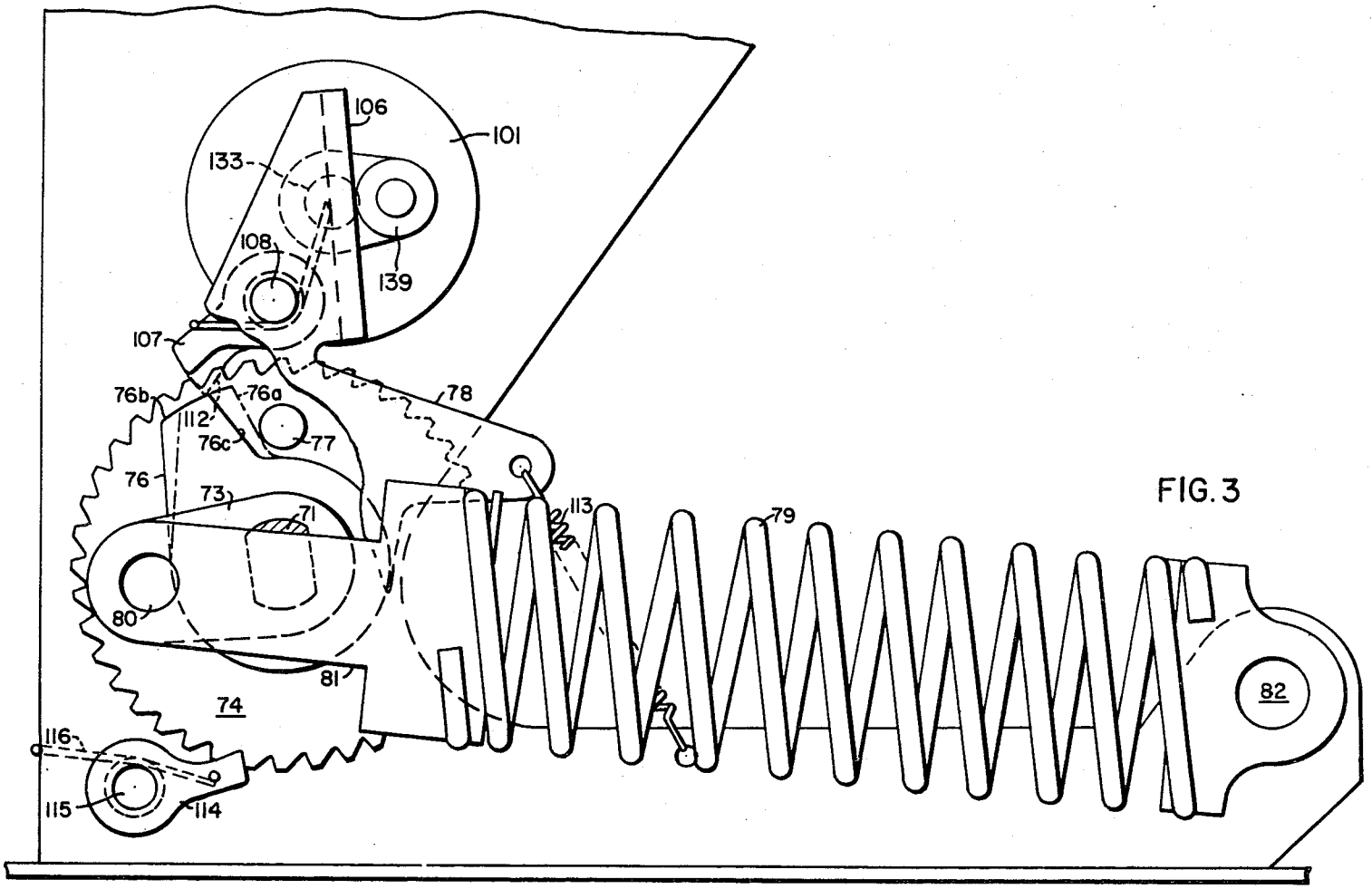
FIG. 3 is a partial sectional view taken generally along the line III—III of FIG. 1 with the crankshaft and the closing spring shown in the charged position.
Figure 4:
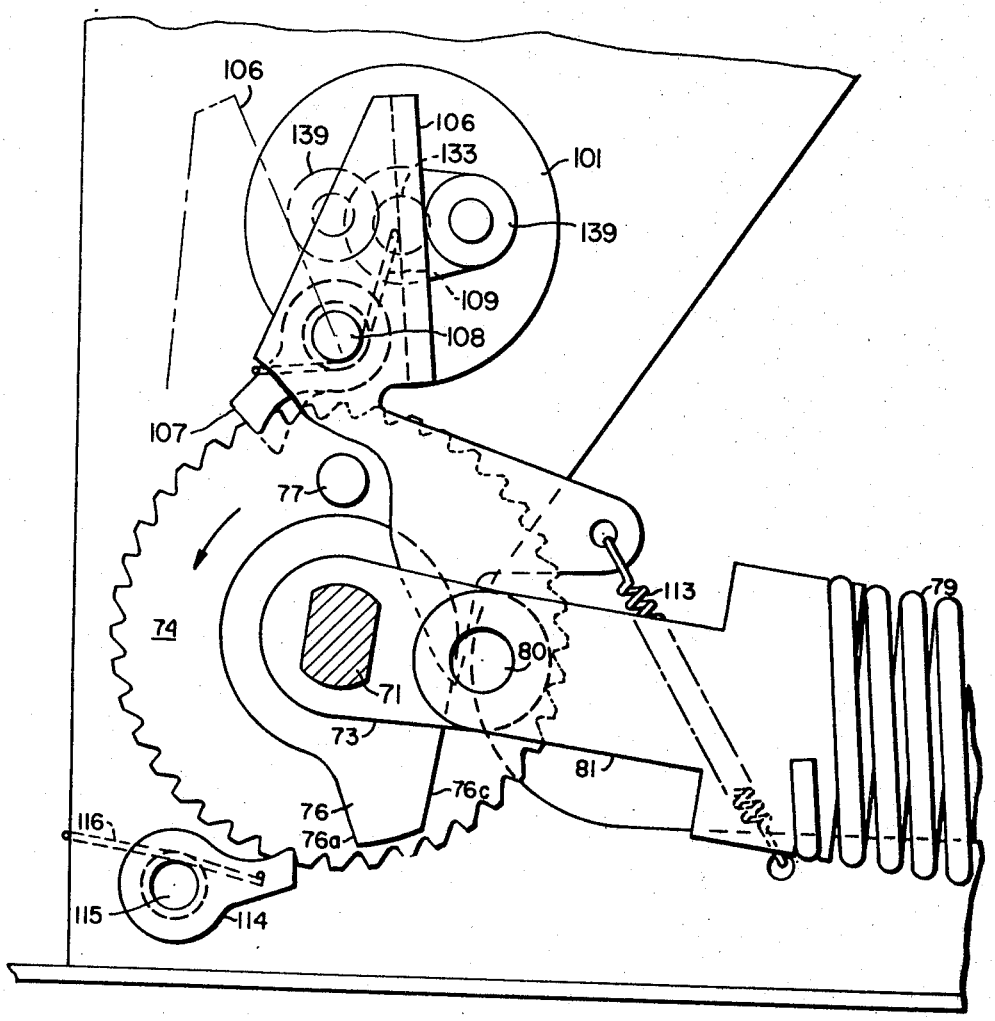
FIG. 4 is a partial sectional view with parts broken away and showing the crankshaft and closing spring in the discharge position and the oscillating drive pawl structure in alternate positions.
Figure 5:
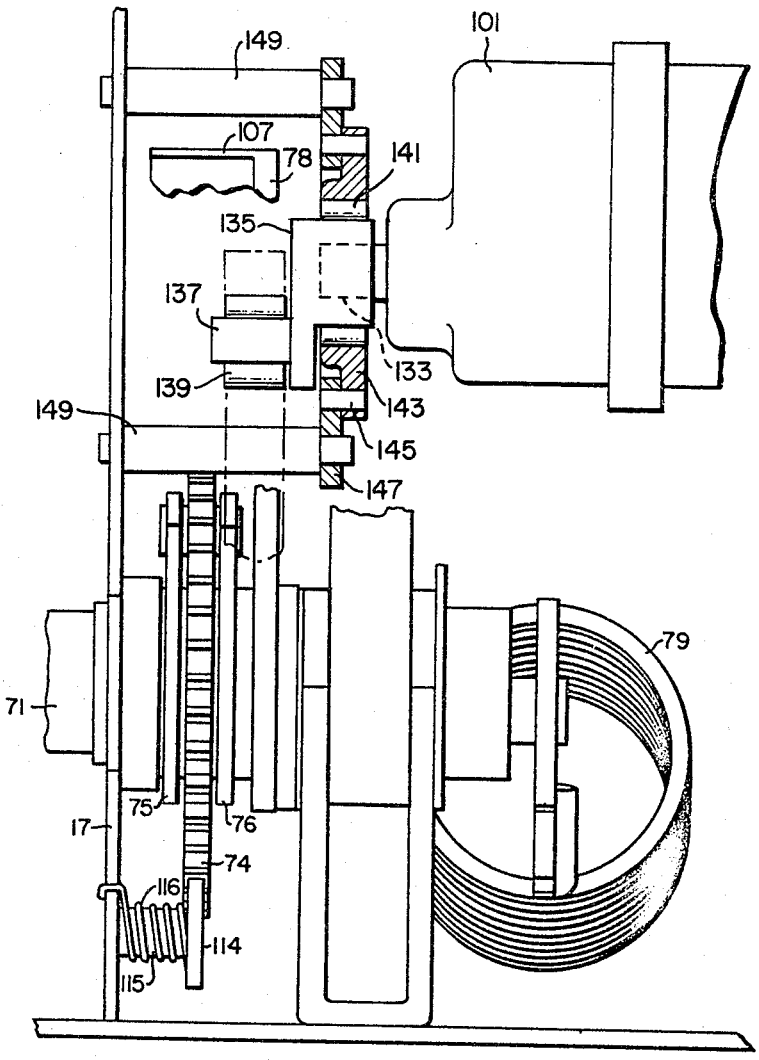
FIG. 5 is an enlarged fragmentary end view of the spring charging mechanism and showing the manner in which the output shaft of the motor is mounted in a bearing assembly.

As shown in FIGS. 3 to 5 a ratchet member or wheel 74 is rotatably mounted on the crank shaft 71, as evidenced by a circular hole 74*a*. A pair of charge plates 75 and 76 are fixedly mounted on the crank shaft 71 and on opposite sides of the ratchet wheel 74. The plates 75 and 76 include the strike surfaces 75*a* and 76*a*, respectively, as well as the camming surfaces 75*b* and 76*b*, respectively. A projection or pin 77 having opposite end portions extending from opposite sides of ratchet wheel 74 are disposed in the paths of travel of the strike surfaces 75*a* and 76*a*. The crank shaft 71, crank arms 73, and plates 75, 76, move in unison as a crank shaft structure 77*a*. An oscillatory member 78 is rotatably mounted on crank shaft 71 where it is supported for pivotal oscillating movement relative to the crankshaft to cooperate with the ratchet wheel 74 and charge plates 75 and 76.

As the member 78 turns the ratchet wheel 74 counterclockwise (FIG. 4) the pin 77 (bearing against the strike surfaces 75*a* and 76*a*) rotates the charge plates 75 and 76 and hence the crankshaft 71 is turned from the discharged position (FIG. 4) to the charge position (FIG. 3). When the charged position is reached, the camming surface 76*b* lifts the lever III (FIG. 3) and the charge pawl 107 is disengaged from the ratchet 74. Once the charge plates reach the charge position as shown by the broken line position 76*a* (FIG. 3), the tension in the springs 79 is sufficient to rotate the pin 80 below a line through the axis of the shaft 71 and the rod 82 to the solid line position of the plates. This action is arrested when the latch roller 67 strikes the member 85 (FIG. 2).

A separate tension spring 79 is operatively connected at the end of each of the crank arms 73 by means of a pivot pin 80. Each of the springs 79 is connected to a spring support 81 that is pivotally connected to the associated arm 73 by means of the associated pivot pin 80. Each of the tension springs 79 is connected, at the other end thereof, to a rod 82 that is secured to the center plate 17. A manual operating mechanism, indicated generally at 83 (FIG. 1), is provided for manually charging the closing springs 79. A latch member 85 (FIG. 2) is pivotally mounted on a pin 87 and biased in a clockwise (FIG. 2) direction to the latching position wherein the latch 85 engages the roller 67 to latch the closing cam 51 and crankshaft 71 to prevent counterclockwise movement of the closing cam 51 and crankshaft 71.

The circuit breaker is shown in FIG. 2 in the contact open position with the stored energy closing springs 79 in the charged condition. As is shown in FIG. 2, the spring support pins 80 of the tension springs 79 are below a line between the center of the spring support rod 82 and the center or axis of the crank of shaft 71 so that the charged tension springs 79 are operating to bias the crankshaft 71 in a counterclockwise direction. Counterclockwise movement of the crankshaft 71 is prevented by the engagement of the latch member 85 with the latch roller 67 that is mounted on the closing cam 51. The latch member 85 is operated to the unlatching position to close the circuit breaker in a manner described in U.S. Pat. No. 3,590,192.

To close the breaker, the latch 85 is pivoted in a counterclockwise (FIG. 2) direction to thereby release the roller 67. When the roller 67 is released, the closing cam 51 and the crankshaft 71 are free to rotate in a counterclockwise direction, and the closing springs 79, operating on the crank arms 73, operate to rotate the crankshaft 71 in a counterclockwise direction as the springs 79 discharge. During this movement, the closing cam 51 will force the roller 49, and the link 41 upwardly to the closed position. During this closing movement of the link 41, of the lever 33 (FIG. 2) of the center pole unit is forced in a counterclockwise direction to rotate the jack shaft 35 counterclockwise to simultaneously move the three contact arms 25 in a clockwise direction about the pivots 29 to the closed position. In the closed position, the engagement of the closing cam 51 with the roller 49 serves to prop the link member 41 in the closed position to thereby maintain the jack shaft 35 and contacts 23 in the closed position.

With the contacts in the closed position and the closing spring 79 discharged, the circuit breaker may be automatically tripped open, in response to an overload above a predetermined value in any of the pole units, by operation of the trip shaft 63 in a manner described in U.S. Pat. No. 3,544,931. During the tripping operation, the trip shaft 63 is rotated in a counterclockwise (FIG. 2) direction. When the trip shaft 63 is rotated counterclockwise, the trip shaft moves to permit the latch member 53 to move into the cut-out portion of the trip shaft 63, thereby permitting the latch member 53 to move in a counterclockwise direction about the pivot 57 to the tripped position. The compressed contact springs 93 (FIG. 2) and an opening spring 99 (FIG. 1) then operate to move the contact arms 25 toward the open position which movement occurs because the pivot 55 is free to move so that the link 45 can move to the tripped position with the toggle 45, 41 collapsing to permit the lever 33 and jack shaft 35 to move in a clockwise direction to the tripped open position. Thus, movement of the trip shaft 63 to the tripped position permits the members 41, 45, 53 to move to the tripped position, wherein the roller 49 and link 41 no longer restrain the lever 33 in the closed position, and the springs 93, 99 operate to move the jack shaft 35 and the three contact arms 25 to the tripped open positions.

With the circuit breaker in the tripped open position, the breaker is reset and the closing springs 79 are charged by operation of the motor-drive structure 101 in a manner to be hereinafter more specifically described. In order to reset the circuit breaker and charge the closing springs 79, the crank arm 73 is rotated from the spring discharged position of FIG. 4 through an angle of more than 180° to the spring charged position of FIGS. 2 and 3. As the crankshaft 71 moves to the position seen in FIG. 2, the roller 49 rides off of the peak of the cam 51 into the depression seen in FIG. 2. When the roller 49 is free to move into the depression of the cam 51, the spring 59 (FIG. 1) biases the latch 53 clockwise (FIG. 2) to move the latch 53 to the reset position pulling links 45, 41 and the roller 49 to the reset position wherein the roller 49 is positioned in the depression of the cam 51 (FIG. 2). When the latch 53 moves out of the notch of the trip shaft 63, suitable spring means operates to rotate the trip shaft 63 clockwise to the latching position wherein the periphery of the trip shaft 63 again latches the latch member 53 to latch the parts in the reset position seen in FIG. 2. As the crankshaft 71 moves more than 180° to the position seen in FIGS. 2 and 5 the springs 79, which are moved over-center, take over to bias the crankshaft 71 in a counterclockwise (FIG. 2) direction, and the roller 67 engages the latch 85 to latch the crankshaft 71 in the charged position seen in FIG. 2, and the circuit breaker is prepared for another closing operation.

When the circuit breaker is in the contact-closed position with the stored energy closing springs 97 discharged the spring closed means is operated to the charged position by operation of the motor-drive structure 101 (FIG. 1) to rotate the crankshaft 71 through an angle of slightly more than 180° (approximately 184°) to charge the springs 79 during which movement the roller 49 rides on a fixed radius of the cam 51 to a position just short of the peak of the cam surface of the cam member 51. This charging movement of the cam 51 is more specifically described in the above-mentioned U.S. Pat. No. 3,590,192.

With the parts in the contact closed spring charged position, the following sequence of operations can occur.

Upon the occurrence of an overload above a predetermined value, the trip means indicated generally at 95 (FIG. 1) is automatically operated to rotate the trip shaft 63 to release the latch member 53 and permit the toggle 41, 45 to effect an opening operation in the same manner as was hereinbefore described. With the toggle 41, 45 collapsed, the spring 59 operates to draw the roller 49 into the depression of the cam 51 resetting the linkages 53, 41, 45 and the trip shaft 63 is moved by spring means into the latching reset position seen in FIG. 2. The parts at the end of this tripping operation are in the position seen in FIG. 2, wherein the mechanism is reset and relatched, and wherein the roller member 49 is in the depression of the cam 51 so that the parts are prepared for a closing operation. When the closing springs 79 are charged, an operator can immediately operate the closing latch 85 (FIG. 2) to release the roller 67 whereupon the circuit breaker is operated to the closed position in the same manner as was hereinbefore described. With the parts in the closed position, if an overload above the predetermined value occurs the trip means 95 will be automatically operated to rotate the trip shaft 63 to the tripped position to effect a tripping operation in the same manner as mentioned before described. With the parts in the tripped position and the closing springs 79 discharged, another charging operation of the closing springs 79 will be required in order to provide another closing operation. Thus, when the circuit breaker is in the contact closed spring charged position, the circuit breaker can be tripped and then closed and then tripped again in rapid sequence.

The oscillatory member 78 (FIGS. 3 to 5) comprises a circular opening 105, a flange or bight portion 106 and is rotatably mounted on the crankshaft 71 for movement relative to the crankshaft about the axis thereof. A charging pawl 107 also is pivotally mounted on the member 78 by means of a pin 108, and a torsion spring 109 biases the pawl in a counterclockwise direction about said pin into engagement with the ratchet wheel 74. The pawl 107 also includes a lever 111 as an integral part which lever has an end portion 112 that is contacted and lifted by the camming surface 75b when the charge plate 75 is in the charge position (FIG. 3), whereby the pawl 107 is raised out of operation with the ratchet wheel teeth. A tension spring member 113 biases the reciprocating member 78 in a clockwise direction (FIG. 3) about the crankshaft 71. A holding pawl 114 is pivotally mounted on one of the center plates 17 by means of a pin 115 and biased in a counterclockwise direction, by means of a torsion spring 116, into engagement with the ratchet wheel 74. The drive motor 101 comprises an output shaft 133 (FIG. 5). An arm 137 is mounted on the end of the shaft 133 and a roller member 139 is rotatably mounted on the arm 137. The arm 137 is an integral part of an adapter 135 that is threadedly mounted on the end of the shaft 133. Or the arm 137 may be an integral part of the shaft 133. The arm 137 of the shaft 133 is disposed on an axis that is eccentric to the axis of the shaft by a distance equal to twice the distance movement of the arm.

The eccentric arm 137 provides an eccentric or crank means by which the oscillatory member 78 is actuated to rotate the ratchet wheel 74. As the shaft 133 rotates the bight portion 106 follows the arm 137 back and forth across the axis of the output shaft 133. As the bight portion 106 turns counterclockwise to rotate the ratchet wheel 74, it is actuated by the arm 137 (or 141) through 180° of rotation of said arm, i.e., between the positions of the arm 137 as shown in FIG. 4.

For reinforcement the adapter 135 is disposed in a bearing 141 that is supported in a bearing flange 143. The flange 143 is retained in place by peripherally spaced pins 145 that are secured to an annular mounting plate 147 that is, in turn secured to the center plate 17 by mounting spacers 149. The mounting spacers 149 are located so that there is no interference with the oscillating member 78.

As can be seen in FIG. 3, the closing springs 79 are in the charged position with the closing latch 85 (FIG. 2) engaging the roller 67 of the cam 51 to latch the crankshaft 71 in the spring charged position shown in FIG. 3. Upon the release of the latch 85, the springs 79 discharge rotating the crankshaft 71 slightly more than 180° to close the circuit breaker in a manner hereinbefore described. Upon discharge of the closing springs 79 suitable limit switch means is actuated in a well known manner by the breaker mechanism to energize the drive motor 101. Upon energization of the drive motor 101, the arm 137 is rotated in a clockwise (FIG. 3) direction about the axis thereof at a suitable rate such as 500 rpm.

During each revolution of the output shaft 133 the roller 136, operating against the bight part 107 of the oscillating member 78 moves said member in a counterclockwise direction during which movement the driving pawl of 109 operates against one of the teeth of the ratchet 74 to advance the ratchet and crankshaft 71. As the roller arm 137 moves 180° from the position seen in FIG. 4, the member 78 will advance the ratchet 74 and crankshaft 71 in a counterclockwise direction, and as the roller arm 137 moves the remaining 180° of a 360° revolution, the spring 113 will return the member 78 to the position seen in FIG. 3 with the holding pawl 121 holding the ratchet 74 and crankshaft 71 in the advanced position. Thus, as the output shaft 133 rotates, the ratchet 74 is advanced by the charging pawl 107 and alternately held by the holding pawl 114 until the crankshaft 71 moves more than 180° to an overcenter position wherein the charged closing springs 79 again bias the crankshaft 71 in a counterclockwise direction with the ratchet 74 and crankshaft 71 becoming latched from closing movement by the latch member 85 (FIG. 2) which engages the roller 67 on the cam 51 that is fixed to the crankshaft 71. When the closing springs 79 reach the fully charged position, the charging pawl 107 is disengaged from the teeth (FIG. 3) of the ratchet 74 so that continued rotation of the motor will not operate against the teeth of the ratchet 74, and the motor can be brought to a stopped condition without damaging the parts and without putting undue forces on the parts. The motor 101 is automatically deenergized by suitable limit switch means in a manner well known in the art.

Upon release of the springs 79, the charge plates 75 and 76 stop ultimately at the position shown in FIG. 4 whereas the pin 77 remains in the same position. When the springs reach the discharged position (FIG. 4), the pivot pin 80 overshoots the dead center position due to the high velocity developed and then oscillates clockwise and counterclockwise with reducing amplitudes until the energy is completely dissipated. However, the ratchet 74 remains stationary and undisturbed by the discharge operation as noted by the similar position of the pin 77 in FIGS. 3 and 4.

What is claimed is:

1. A circuit breaker comprising a pair of contacts operable between open and closed positions, a crankshaft structure, closing spring means connected to said crankshaft structure, a ratchet wheel movable to move said crankshaft structure from a spring discharged position to a spring charged position to charge said closing spring means releasable latch means latching said crankshaft structure in said spring charged position, an oscillating drive pawl structure in driving engagement with said ratchet wheel, operating means comprising a motor having an output shaft operable to oscillate said drive pawl structure to move said ratchet wheel to thereby move said crankshaft structure from said spring discharged position to said spring charged position, and the oscillating drive pawl structure comprising a bight portion movable across the axis of the output shaft.

2. The circuit breaker of claim 1 in which there are disengaging means operating automatically when said crankshaft structure is moved to said spring charged position to move said drive pawl structure out of driving engagement with said ratchet wheel.

3. The circuit breaker of claim 1 in which the crank means comprises an eccentric portion of the output shaft.

4. The circuit breaker of claim 3 in which the eccentric portion is an integral part of the output shaft.

5. The circuit breaker of claim 1 in which the bight portion is biased in a retracted position and is movable to move the ratchet wheel.

6. The circuit breaker of claim 5 in which the crank means moves the bight portion to effect movement of the ratchet wheel during half of the rotation of the crank means.

7. The circuit breaker of claim 3 in which support means for the output shaft is provided between the motor and the eccentric portion.

8. The circuit breaker of claim 7 in which the circuit breaker comprises a support plate and the support means comprises reinforcing members secured to said support plate.

* * * * *